US007886643B2

(12) United States Patent
Kaneko et al.

(10) Patent No.: US 7,886,643 B2
(45) Date of Patent: Feb. 15, 2011

(54) SHEET CUTTING APPARATUS, SHEET FINISHER PROVIDED THEREWITH AND IMAGE FORMING SYSTEM EQUIPPED THEREWITH

(75) Inventors: Masahiro Kaneko, Hino (JP); Toshio Shida, Higashiyamato (JP); Hiroyuki Wakabayashi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 582 days.

(21) Appl. No.: 11/159,730

(22) Filed: Jun. 23, 2005

(65) Prior Publication Data

US 2006/0086220 A1 Apr. 27, 2006

(30) Foreign Application Priority Data

Oct. 14, 2004 (JP) ..... 2004-299765

(51) Int. Cl.

*B26D 5/20* (2006.01)
*B26D 5/00* (2006.01)
*B26D 7/02* (2006.01)
*B26D 5/08* (2006.01)

(52) U.S. Cl. ..... 83/356.2; 83/642; 83/646; 83/374; 83/452

(58) Field of Classification Search ..... 83/642, 83/643, 29, 51, 437.6, 437.2, 411.1, 382, 83/315, 355, 282, 188, 92.1, 401, 425, 557, 83/561, 714, 549, 571, 670, 927; 234/118
See application file for complete search history.

(56) References Cited

U.S. PATENT DOCUMENTS 1,416,800 A * 5/1922 Detjen ..... 83/636
2,524,917 A * 10/1950 Lynnequest ..... 83/379
3,117,578 A * 1/1964 Helbling ..... 606/28

(Continued)

FOREIGN PATENT DOCUMENTS

JP 6-71596 A 3/1994

(Continued)

OTHER PUBLICATIONS

Japanese Office Action for Japanese Patent Application No. 2004-299765 drafted Mar. 7, 2008 with English Translation.

(Continued)

*Primary Examiner*—Ghassem Alie
*Assistant Examiner*—Bharat C Patel
(74) *Attorney, Agent, or Firm*—Cantor Colburn LLP

(57) ABSTRACT

A sheet cutting apparatus includes: a cutting blade for cutting an edge of a sheet bundle conveyed to a cutting position of the sheet bundle; a cutting blade moving section for moving obliquely the cutting blade with respect to a sheet surface of the sheet bundle; a fixed supporting table for supporting the sheet bundle in a vicinity of the cutting position; a blade receiving member for pressing the sheet bundle and receiving the cutting blade in the vicinity of the cutting position; and a blade receiving member moving section for ascending or descending the blade receiving member. A center position of a load application action of the blade receiving member by the blade receiving member moving section, is set to a position upstream of the sheet cutting position in a conveying direction of the sheet bundle, and in the vicinity of the sheet cutting position.

11 Claims, 12 Drawing Sheets

U.S. PATENT DOCUMENTS

| | | | | |
|---|---|---|---|---|
| 3,182,542 | A * | 5/1965 | Cochran | 83/453 |
| 3,677,117 | A * | 7/1972 | Cutter | 83/150 |
| 4,207,667 | A * | 6/1980 | D'Angelo et al. | 29/417 |
| 5,209,149 | A * | 5/1993 | Mohr | 83/91 |
| 5,833,380 | A * | 11/1998 | Hosomi et al. | 400/621 |
| 6,347,896 | B1 * | 2/2002 | Robinson | 400/621 |
| 6,520,058 | B2 * | 2/2003 | Nakajima et al. | 83/206 |
| 2001/0054342 | A1 * | 12/2001 | Kato et al. | 83/78 |
| 2004/0096253 | A1 * | 5/2004 | Ueno et al. | 399/385 |
| 2006/0130626 | A1 * | 6/2006 | Nishimura et al. | 83/638 |

FOREIGN PATENT DOCUMENTS

| | | | |
|---|---|---|---|
| JP | 6-210593 | A | 8/1994 |
| JP | 2001-240296 | A | 9/2001 |
| JP | 2003-136471 | | 5/2003 |
| JP | 2003-136471 | A | 5/2003 |
| JP | 2003-228205 | | 8/2003 |

OTHER PUBLICATIONS

Japanese Office Action for Japanese Patent Application No. 2004-299765 mailed Mar. 10, 2009 with English Translation.

* cited by examiner

FIG. 8 ( a )
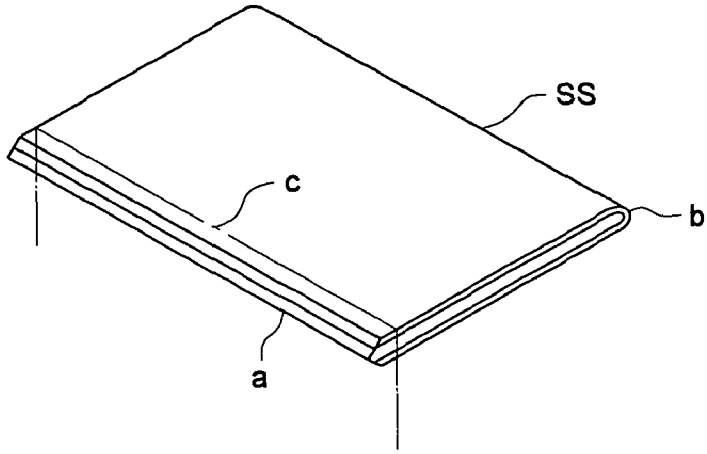
FIG. 8 ( b )
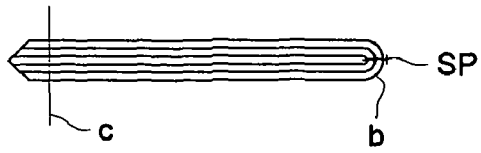
FIG. 8 ( c )
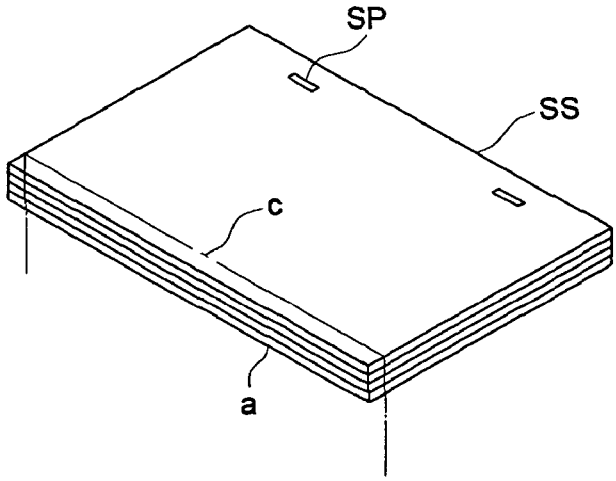
FIG. 8 ( d )
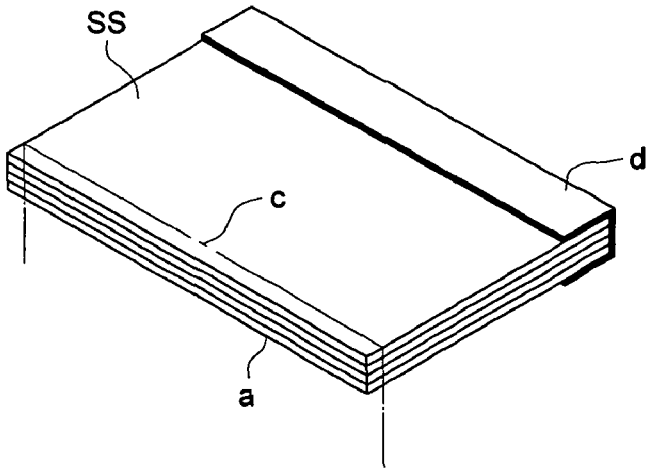

SHEET CUTTING APPARATUS, SHEET FINISHER PROVIDED THEREWITH AND IMAGE FORMING SYSTEM EQUIPPED THEREWITH

This application claims priority from Japanese Patent Application No. 2004-299765 filed on Oct. 14, 2004, which is incorporated hereinto by reference.

BACKGROUND OF THE INVENTION

The present invention relates to a sheet cutting device that cut several sheets of paper, to a sheet finishing apparatus equipped with the sheet cutting device, and to an image forming systems provided with the sheet finishing apparatus.

A Sheet finisher carrying out various types of finishing is connected to a high speed image forming apparatus such as an image forming apparatus employing the electro-photography method, and multiple-functional image forming systems have come into wide use that make it possible to carry out within a single apparatus various types of finishing operations such as stapling and folding of paper sheets on which images have been formed.

Among the different types of finishers there is the sheet cutting apparatus that aligns the edges of a bundle of a plurality of sheets, and an image forming system having a sheet cutting apparatus that cuts the edges of sheets that have been subjected to center-folding and center-stapling has been disclosed, for example, in Japanese Unexamined Patent Application Laid-Open No. 2003-228205. The sheet cutting apparatus disclosed in the Japanese Unexamined Patent Application Laid-Open No. 2003-228205 is of the type commonly referred to as the guillotine type and is one in which the cutting done by pressing the cutting blade from a direction perpendicular to the sheet surface.

In the sheet cutting apparatus disclosed in Japanese Unexamined Patent Application Laid-Open No. 2003-136471, there is a sheet pressing member that presses the bundle of sheets including a plurality of sheets placed one upon the other so that the position of the bundle of sheets does not get shifted, the cutting blade (cutter) is placed below the sheet pressing member and can move in a diagonally upward direction. A link is attached to the sheet pressing member so that it can be raised or lowered using a drive section. In this sheet cutting apparatus, the positioning of parts is made so that the central position of the load application action of the sheet pressing member capable of being raised and lowered is almost directly above the cutting edge of the cutter.

Since the guillotine type of sheet cutting apparatus described in the Japanese Unexamined Patent Application Laid-Open No. 2003-228205 cuts the bundle of sheets by moving the cutting blade in a direction perpendicular to the sheet surface, a large force is required for driving it. And also, since it is necessary to set the power of the driving section at the maximum value in the usable range, there is the requirement for a large power and large sized motor and a power supply with a large power capacity resulting in the problems that not only the apparatus becomes large but also the power consumption becomes large. In particular, it becomes difficult to incorporate a sheet cutting apparatus in a sheet finishing apparatus that is a part constituting an image forming system.

In the sheet cutting apparatus disclosed in the Japanese Unexamined Patent Application Laid-Open No. 2003-136471, since the central point of the lower surface of the sheet pressing member is in a state in which it has projected beyond the edge surface of the table supporting the bundle of sheets, at the time of cutting the edge of the bundle of sheets by raising the cutting blade in a diagonally upward direction while pressing the sheets placed on the table using a sheet pressing member, it is likely that the sheet pressing member becomes inclined thereby applying a load on the cutter. In particular, at the time of cutting a number of sheets of paper such as when cutting 50 to 100 sheets, an abnormally high load may be applied on the cutting blade. Because of this, the driving load of the cutting blade moving section becomes large. In addition, the cut edge surface of the bundle of sheets does not become perpendicular to the sheet surface and the sheets do not become aligned, thereby lowering the quality of the finished booklets.

SUMMARY

The present invention was made with an object of solving the problems of conventional sheet cutting apparatuses such as the apparatus becoming too large or the quality of the cut edge surface becoming deteriorated, and in particular, an object of the present invention is to provide a sheet cutting apparatus that is ideally suited for use as a part of an image forming system, a sheeting finishing apparatus provided therewith and an image forming system equipped therewith.

The above objects can be achieved by having the following configuration.

A sheet cutting apparatus including the following: a cutting blade that cuts the bundle of sheets transported to the cutting position; a cutting blade moving section that moves the cutting blade in a diagonal direction with respect to the sheet surface of the bundle of sheets; a fixed supporting table that supports the bundle of sheets in the neighborhood of the cutting position; a cutting blade receiving member that not only presses the bundle of sheets in the neighborhood of the cutting position but also receives the cutting blade; and a cutting blade receiving member moving section that raises and lowers the cutting blade receiving member, wherein the central position of the load application action of the cutting blade receiving member by the cutting blade receiving member moving section is set on the upstream side of the sheet bundle transporting direction relative to the cutting position and in the neighborhood of the cutting position.

BRIEF DESCRIPTION OF THE DRAWINGS

FIGS. 8(*a*), 8(*b*), 8(*c*), and 8(*d*) are the perspective views and the cross-sectional views of different types of sheet bundles that are cut.

DETAILED DESCRIPTION OF THE PREFERRED EMBODIMENT

Figure 1:
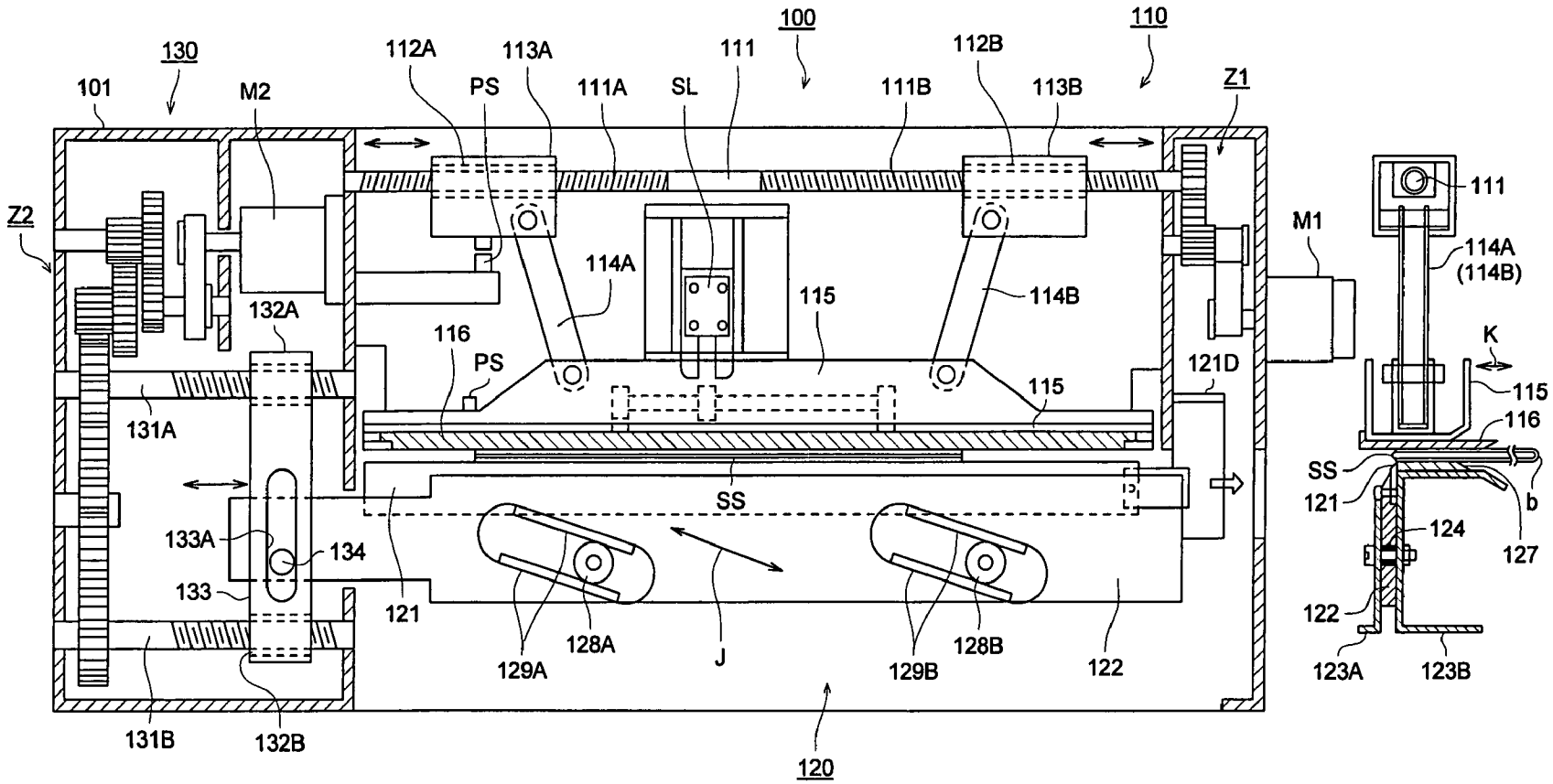
FIGS. 1(*a*) and 1(*b*) are respectively the front view and the side view of the important parts of the sheet cutting apparatus according to the present invention.

A preferred embodiment of the present invention will be described while referring to the drawings, as follows.

Figure 2:
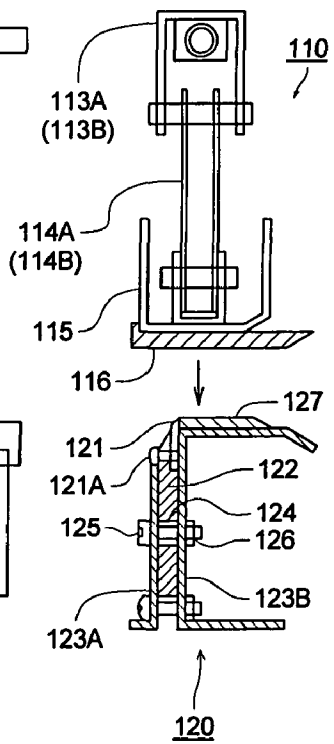
FIGS. 2(*a*) and 2(*b*) are respectively the front view of the important parts and the side view of the important parts showing the standby state of the sheet cutting apparatus.
Figure 2:
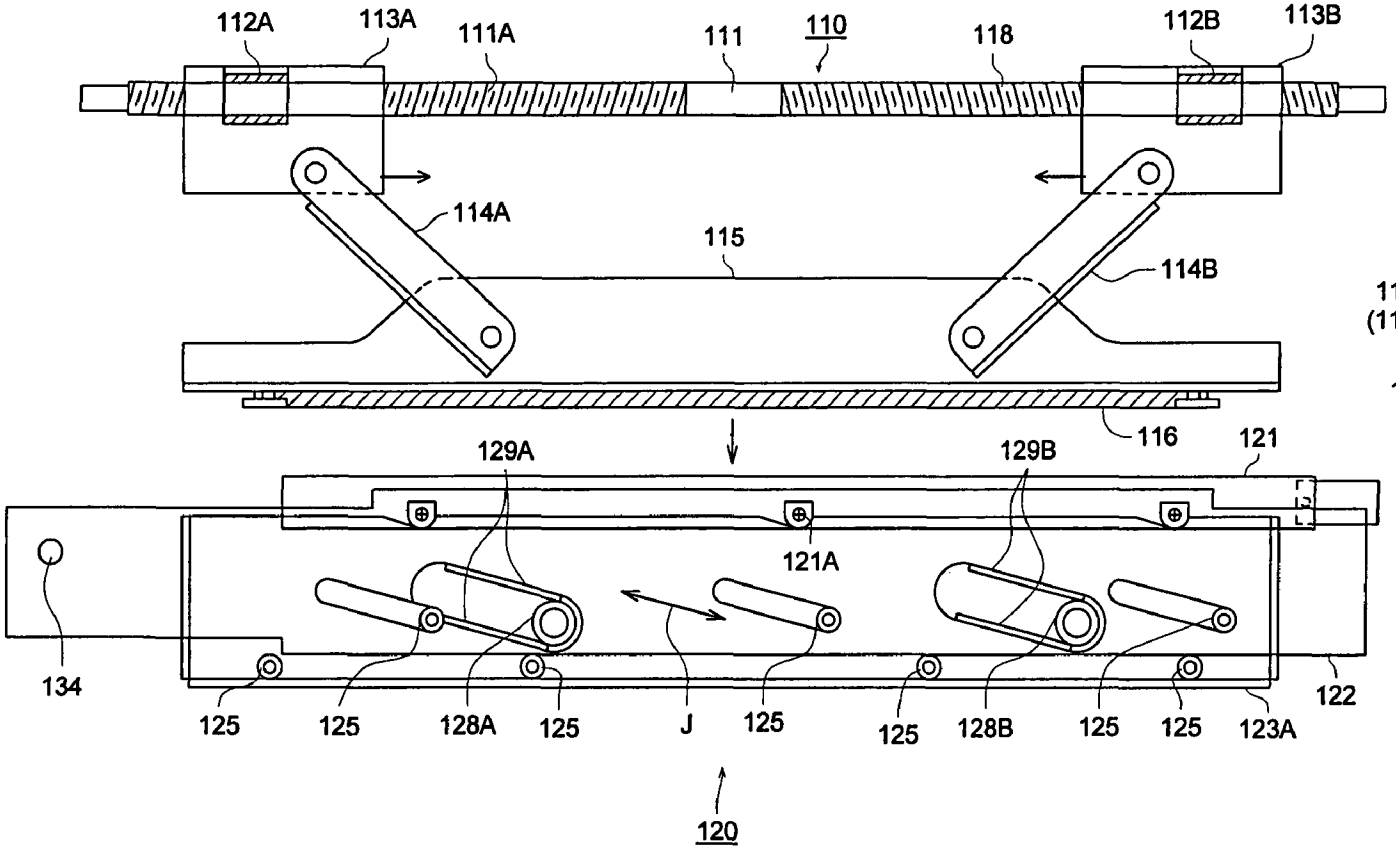
Figure 3:
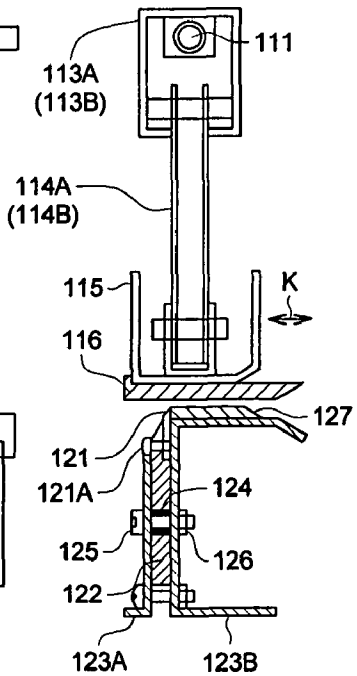
FIGS. 3(*a*) and 3(*b*) are respectively the front view of the important parts and the side view of the important parts showing the sheet cutting starting state of the sheet cutting apparatus.
Figure 3:
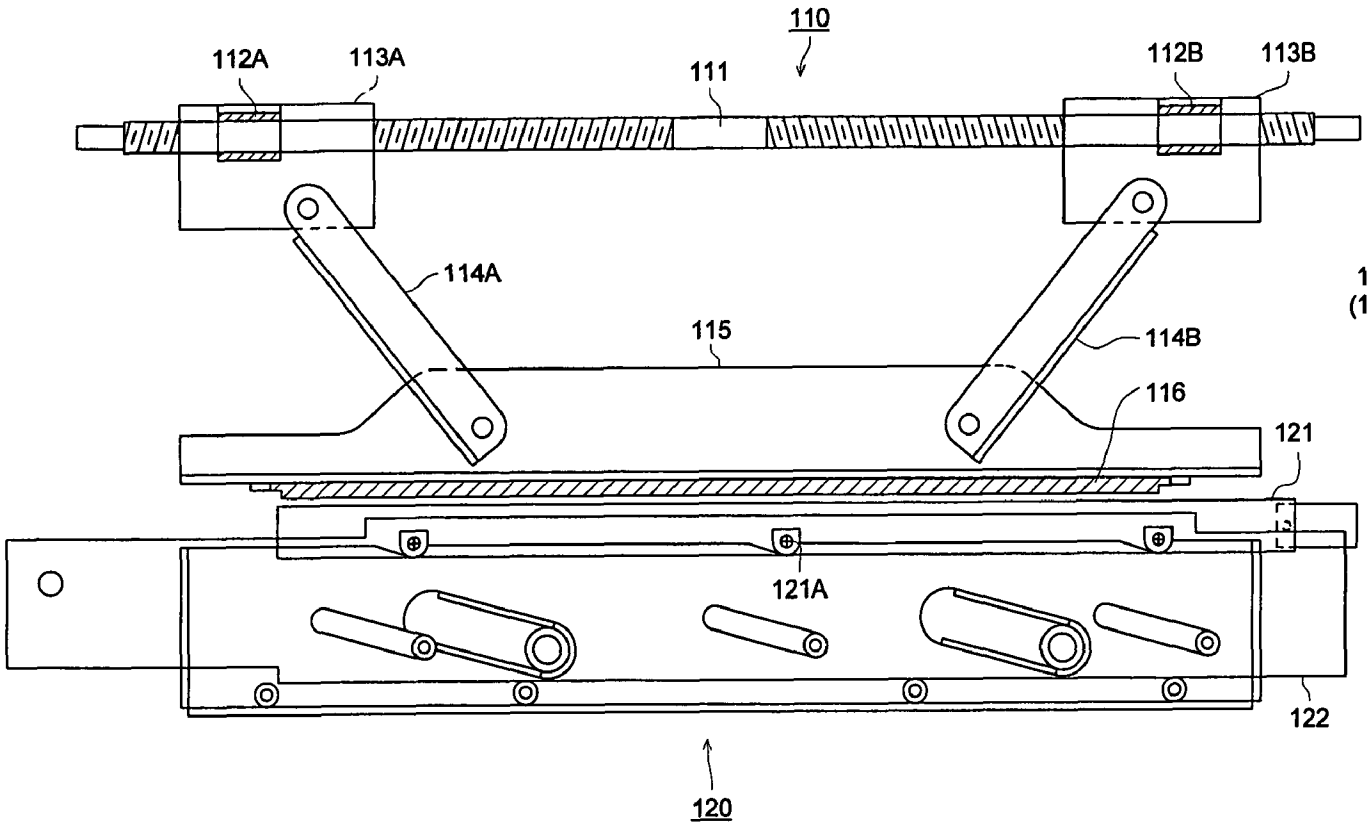
Figure 4:
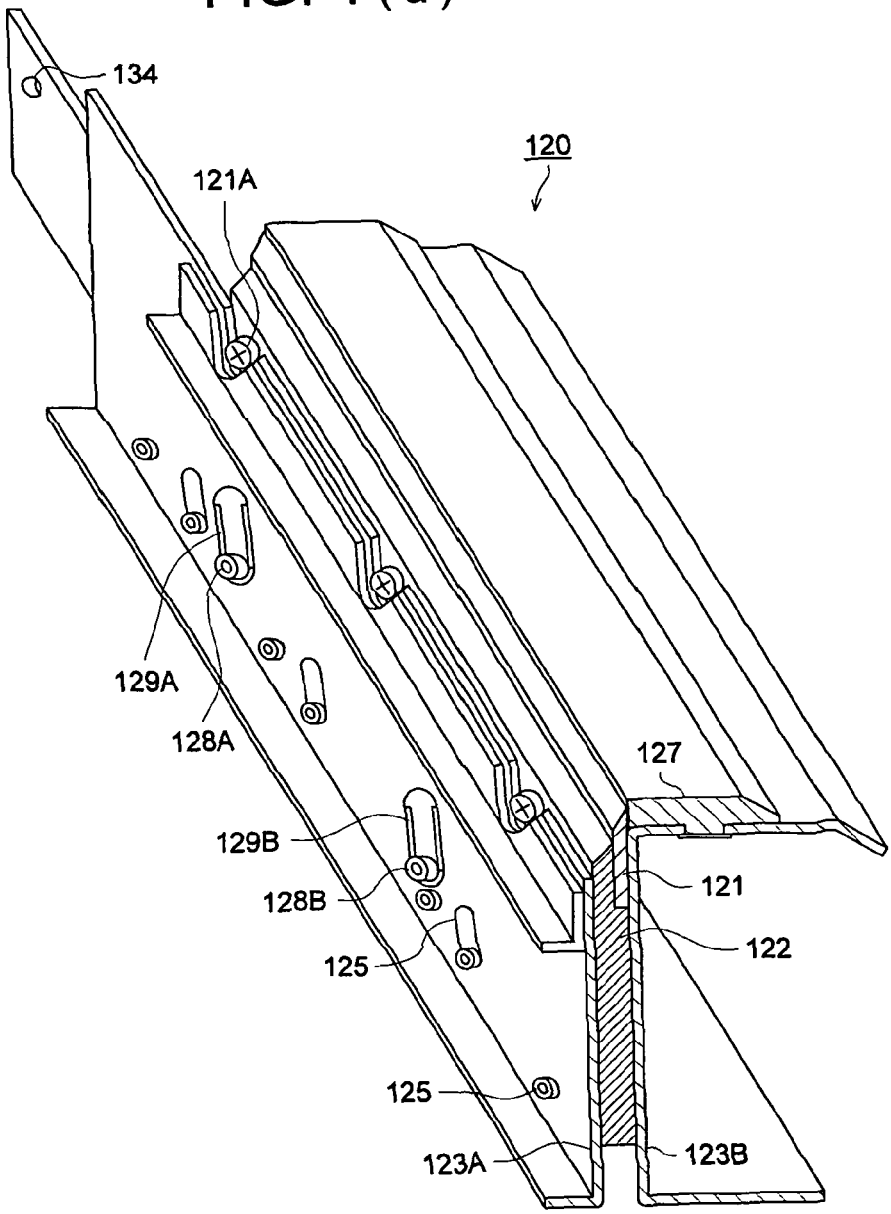
FIGS. 4(*a*) and 4(*b*) are respectively the perspective view of the important parts and the cross-sectional view of the important parts of the cutting blade moving section.
Figure 4:
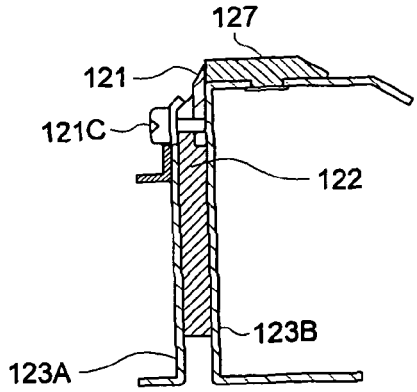

FIG. 1(*a*) is the front view of the sheet cutting apparatus according to the embodiment and FIG. 1(*b*) is the side view of its important parts. FIG. 2(*a*) is the front view of the important parts showing the standby state of the sheet cutting apparatus and FIG. 2(*b*) is the side view of its important parts. FIG. 3(*a*) is the front view of the important parts showing the sheet cutting starting state of the sheet cutting apparatus and FIG. 3(*b*) is the side view of its important parts. FIG. 4(*a*) is the perspective view of the important parts of the cutting blade moving section 120 and FIG. 4(*b*) is the cross-sectional view of the important parts of the cutting blade moving section 120.

In FIGS. 1(*a*) and 1(*b*), the cutting blade receiving member moving section 110 is placed on top of the body 101 of the sheet cutting apparatus 100, the cutting blade moving section 120 is placed under the body 101, and the cutting blade moving section 130 is placed on the left side surface of the body 101 as shown in the figure.

The edge of the bundle of the sheets SS transported into the sheet cutting apparatus 100 is cut due to the vertically downward movement of the cutting blade receiving member 116 of the cutting blade receiving member moving section 110 and the diagonally upward movement of the cutting blade 121 of the cutting blade moving section 120. The details of the cutting blade receiving member moving section 110, the cutting blade moving section 120, and the cutting blade moving section 130 are described below.

(Cutting Blade Receiving Member Moving Section)

A rotating shaft 111 supported at both ends is provided on top of the cutting blade receiving member moving section 110. The rotating shaft 111 is rotated by the first driving section having the drive transmission section Z1 constituted by a motor M1, a belt, and gear wheels.

The rotating shaft 111 is provided with the screw sections 111A and 111B having the same pitch but having helix angles in mutually opposite directions, and the nut 112A mates with the screw section 111A while the nut 112B mates with the screw section 111B. Due to the rotation of the rotating shaft 111, the moving body 113A carrying the nut 112A and the moving body 113B carrying the nut 112B carry out linear movement in mutually opposite directions.

The bottom end of the coupling link 114A supported rotatably at a part of the moving body 113A mates with the left top part in the figure of the edge pressing member 115 and supports it so that it can be raised or lowered. In a similar manner, the bottom end of the coupling link 114B supported rotatably at a part of the moving body 113B mates with the right top part in the figure of the edge pressing member 115 and supports it so that it can be raised or lowered.

Therefore, the rotating shaft 111 is rotated by the rotation of the motor M1, the moving bodies 113A and 113B move in the left to right direction, thereby changing the inclinations of the coupling links 114A and 114B as a result of which the edge pressing member 115 moves up and down in a parallel state.

The cutting blade receiving member 116 is fixed to the lower surface of the edge pressing member 115, and moves in the up and down direction while being parallel to the cutting edge of the cutting blade 121 along with the edge pressing member 115. The cutting blade receiving member 116 is made of a synthetic resin.

In this manner, the first drive section constituted by the motor M1 and the drive transmission section, the rotating shaft 111, the moving bodies 113A and 113B, the coupling links 114A and 114B, the edge pressing member 115, and the cutting blade receiving member 116 constitute the cutting blade receiving member moving section 110.

Since the edge pressing member 115 supporting the cutting blade receiving member 116 is driven by a drive mechanism with a large reduction ratio and including the screw sections 111A and 111B, it presses and holds the bundle of sheets SS gripped between the cutting blade receiving member 116 and the fixed supporting table 127 with a strong force.

The edge pressing member 115 carrying the cutting blade receiving member 116 is made to slide by a solenoid S L after a predetermined number of cutting operations by a driving section not shown in the figure in the direction of the arrow K, that is, in a direction at right angles to the longitudinal direction of the cutting blade 121.

(Cutting Blade Moving Section)

In FIGS. 2(*a*) and 2(*b*), the cutting blade moving section 120 is constituted by the cutting blade 121, the cutting blade holder 122, the supporting plates 123A and 123B that support the cutting blade holder 122 in a movable manner, the spacing retention member 124 that sets the spacing between the surfaces of the supporting plates 123A and 123B, the fixing section comprising the coupling member 125 that links the supporting plates 123A and 123B via the spacing retention member 124 and the tightening member 126, and the fixed supporting table 127 placed in the neighborhood of the edge part of the bundle of sheets SS.

The cutting blade 121 having the cutting edge formed on its top edge is fixed to the cutting blade holder 122 by the male screw member 121A. The cutting blade holder 122 is supported so that it can move between the opposing surfaces of the pair of supporting plates 123A and 123B arranged in parallel. The spacing retention member 124 is gripped between the opposing surfaces of the supporting plates 123A and 123B and the spacing is maintained so that the cutting blade holder 122 can move in that space.

The coupling member 125 provided with a male screw passes through the supporting plates 123A and 123B and the spacing retention member 124 having a hollow cylindrical shape, mates with the tightening member 126 having a spring washer and a hexagonal nut, and holds and tightens the supporting plates 123A and 123B with a specific spacing between them.

The spacing between the opposing surfaces of the supporting plates 123A and 123B provided due to the spacing retention member 124 is set to be in a range of dimensions to have a gap of about 0.1 mm to 0.5 mm relative to the thickness of the cutting blade holder 122 and the spacing is such that the cutting blade holder 122 can move up and down without any hindrance.

A plurality of coupling section composed of the coupling member 125 and the tightening member 126 are provided at various locations of the supporting plates 123A and 123B (for example, at the seven locations shown in FIGS. 2(*a*) and 2(*b*)) and maintain the specific spacing firmly.

The rollers 128A and 128B are fixed to the cutting blade holder 122, and the rollers 128A and 128B are guided in the direction of the arrow J by the guide members 129A and 129B fixed to the body 101 in a state in which they are inclined downward toward the right.

(Cutting Blade Driving Section)

In FIGS. 1(*a*) and 1(*b*), the cutting blade driving section 130 is constituted by the motor M2, the drive transmission section Z2, and the moving body 133, etc.

The rotating shafts 131A and 131B supported at both ends are mounted in parallel on the body 101. The rotating shafts 131A and 131B with screws threaded on them rotate in the same direction being driven by the second driving section that has the motor M2 and the drive transmission section Z2 comprising a belt and gear wheels.

The screws threaded on the rotating shafts 131A and 131B are respectively provided with the nuts 132A and 132B. The moving body 133 carrying the nuts 132A and 132B carries out linear movement due to the rotation of the rotating shafts 131A and 131B.

The pin 134 fixed to the cutting blade holder 122 engages in a movable manner with the long hole section 133A provided in the moving body 133. Because the moving body 133 carries out left-right linear motion as shown in the figure and the cutting blade holder 122 carries out left-right linear motion via the pin 134, the rollers 128A and 128B fixed to the cutting blade holder 122 move in a diagonally upward direction indicated by the arrow J along the guide members 129A and 129B.

The bundle of sheets SS introduced into the sheet cutting apparatus 100 is transported by a transport section not shown in the figure on to the fixed supporting table 127 of the cutting blade moving section 120 with its edge 'a' at the front and comes to a stop at a specific position, the bundle of sheets SS is clamped between the fixed supporting table 127 and the blade receiving member 116 that moves down, and the edge 'a' is cut by the raising cutting blade 121.

(Operation of the Sheet Cutting Apparatus)

Next, the operation of the sheet cutting apparatus 100 is described below.

In FIGS. 1(*a*), 1(*b*), 2(*a*), and 2(*b*), in the standby state, the moving body 113A is positioned at the left end and the moving body 113B is positioned at the right end, the blade receiving member 116 is at the upper limit position, and the cutting blade 121 waits at the lower limit position.

When the bundle of sheets SS is introduced into the sheet cutting apparatus 100, the motor M1 starts rotating and drives the moving bodies 113A and 113B and the edge pressing member 115 is lowered via the coupling links 114A and 114B. The motor M1 stops when the edge pressing member 115 is at a position where it is detected by the detection section PS and the edge pressing member 115 stops.

As described later, the edge pressing member 115 can press the bundle of sheets SS with a sufficiently large force so that there is no shifting of the bundle of sheets comprising a plural number of sheet one upon the other when they are subjected to a force in the horizontal direction due to the cutting blade 121 because of the above configuration.

When the pressing of the bundle of sheets SS is completed, the motor M1 starts rotating, and the cutting blade 121 starts moving upward towards the left in the direction of the arrow J. The bundle of sheets SS is cut due to this movement of the cutting blade 121. Since the cutting effect of the cutting blade 121 is the cutting due to the sliding of the cutting blade 121 in a diagonally upward direction, the cutting can be made with a comparatively small driving force, and also, even when the number of sheets to be cut is large only the movement stroke of the cutting blade 121 changes but the driving force does not change.

As is shown in FIGS. 3(*a*) and 3(*b*), when all the sheets in the bundle of sheets are cut the cutting edge of the cutting blade 121 comes into contact with the cutting blade receiving member 116 and the driving force of the cutting blade 121 increases. The increase in the motor drive current due to the increase in the load of motor M1 caused by this increase of the driving force is detected by the control section which then stops the drive of the motor M1. In this manner, all the sheets in the bundle of sheets SS are cut.

When the edge cutting process is completed, the motor M2 rotates in the reverse direction thereby lowering the cutting blade 121 in the downward right direction of the arrow J in FIGS. 1(*a*) and 1(*b*). When the lowering of the cutting blade 121 is completed, the edge pressing member 115 is raised to the initial position due to the reverse rotation of the motor M1.

After the raising of the edge pressing member 115 is completed, and when the folding line pressing member and the receiving plate, not shown in the figure, that had been pinching the bundle of sheets SS at the folding line section 'b' return to their initial positions, the edge pressing member 115 and the cutting blade receiving member 116 raise up thereby releasing the clamping of the bundle of sheets SS.

The edge cutting process of the bundle of sheets SS is completed at the end of the above sequence of operations.

Due to repeated cutting operations, the cutting blade receiving member 116 gets cut by the cutting blade 121, although to a very small extent, and as a result, a cut groove T is formed in the cutting blade receiving member 116. When the depth of this cut groove T becomes large, cutting defects may occur, such as uncut portions remaining in the bundle of sheets or the end surface of the cut edge 'a' not being flat.

In order to prevent this, a setting is made so that the cutting blade receiving member 116 is displaced at the right angles to the longitudinal direction of the cutting blade 121 in the direction of arrow K, so that an unused part of the cutting blade receiving member 116 starts receiving the cutting edge of the cutting blade 121. In other words, by operating the solenoid SL shown in FIGS. 1(*a*) and 1(*b*) the cutting blade receiving member moving section 110 is operated thereby moving slightly the cutting blade receiving member 116 in the direction of the arrow K.

Because of this, although a plural number of cut grooves T are formed, it is possible to limit their depths to within a permissible range and hence there is no occurrence of cutting defects due to deep cut grooves.

(Central Position of Load Application Action of Cutting Blade Receiving Member Moving Section and Cutting Blade Moving Section)

Figure 5:
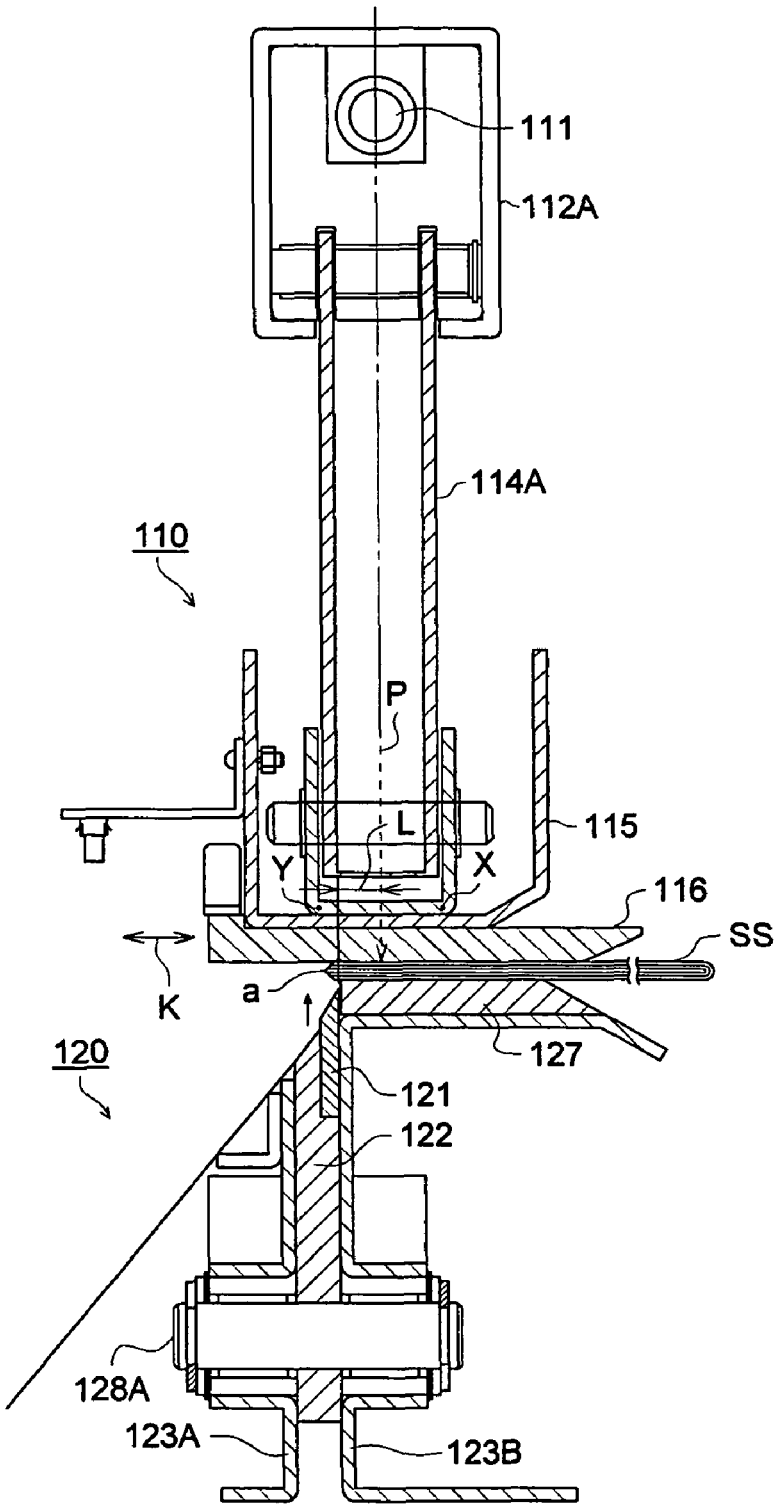
FIG. 5 is the enlarged cross-sectional view showing the sheet bundle pressing state due to the cutting blade receiving member moving section and the cutting blade moving section.
Figure 6:
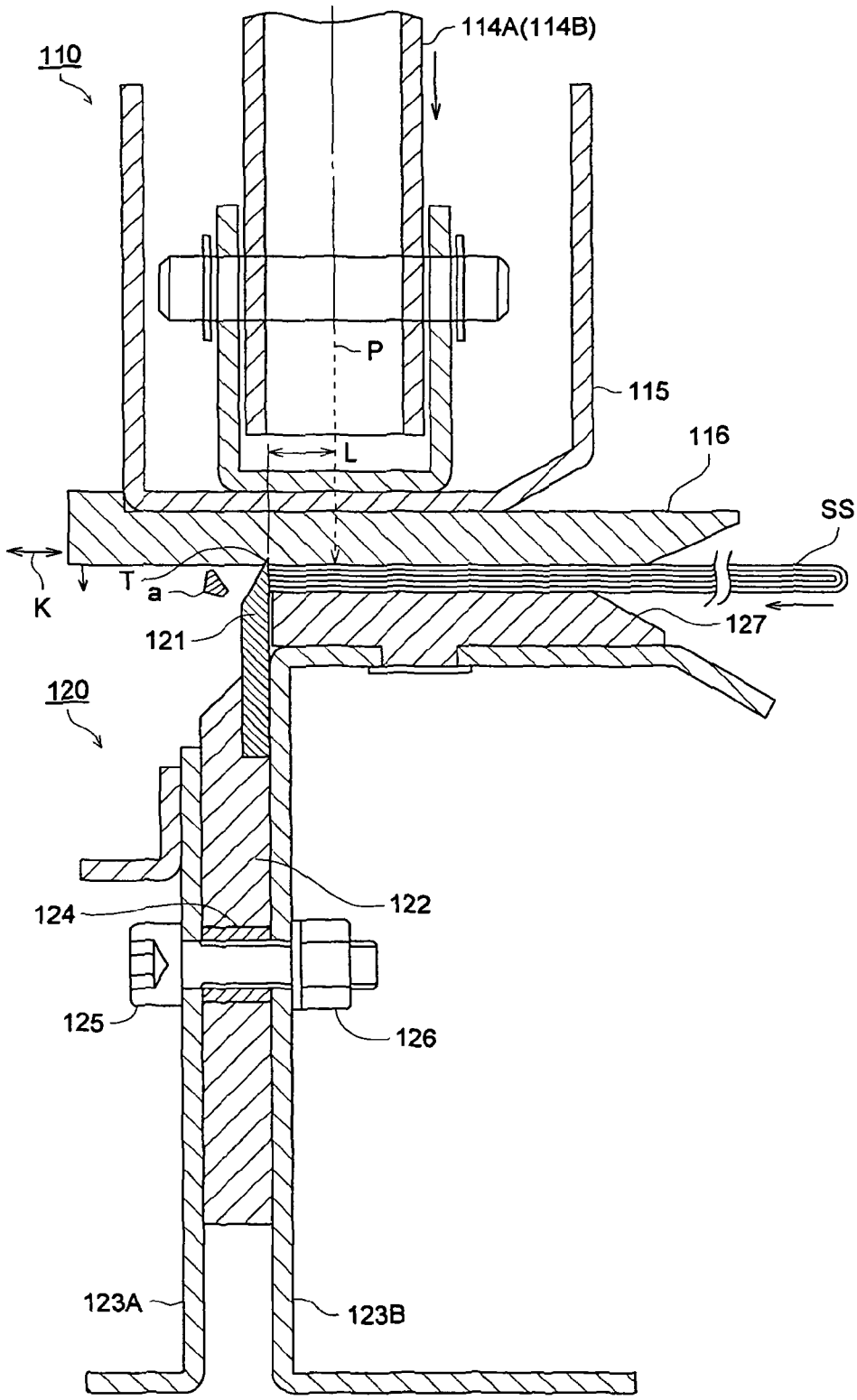
FIG. 6 is the enlarged cross-sectional view showing the sheet bundle cutting state due to the cutting blade receiving member moving section and the cutting blade moving section.

FIG. 5 is the enlarged cross-sectional view showing the sheet bundle pressing state due to the cutting blade receiving member moving section 110 and the cutting blade moving section 120. FIG. 6 is the enlarged cross-sectional view showing the sheet bundle cutting state due to the cutting blade receiving member moving section 110 and the cutting blade moving section 120.

The central position P of load application action of the cutting blade receiving member 116 due to the cutting blade receiving member moving section 110 was set to be in the neighborhood of the upstream side in the sheet transport direction beyond the sheet cutting position of the cutting edge of the cutting blade 121. The central position P of load application action is the point of action of the cutting edge receiving member 116 pressing on the bundle of sheets SS via the coupling links 114A and 114B and the edge pressing member 115 and is vertically below the rotating shaft 111 shown in FIG. 5.

The central position of load application action refers to the center point of the part of the receiving member 115 where it receives the load. When there are a number of areas in which the cutting blade receiving member 116 receives the load, The central position is a central position of the areas.

Explaining this using FIG. 5 for the present preferred embodiment, the central position of load application action will be the central position of the two points in the cutting blade receiving member 116 receiving the load via the coupling link 114A, that is, the position at the lower part of the point P in the figure.

The distance L from the position of the cutting edge of the cutting blade 121 to the central position P of load application action is set to within about 0.5 to 5 mm on the upstream side looking towards the sheet bundle transport direction.

Figure 7:
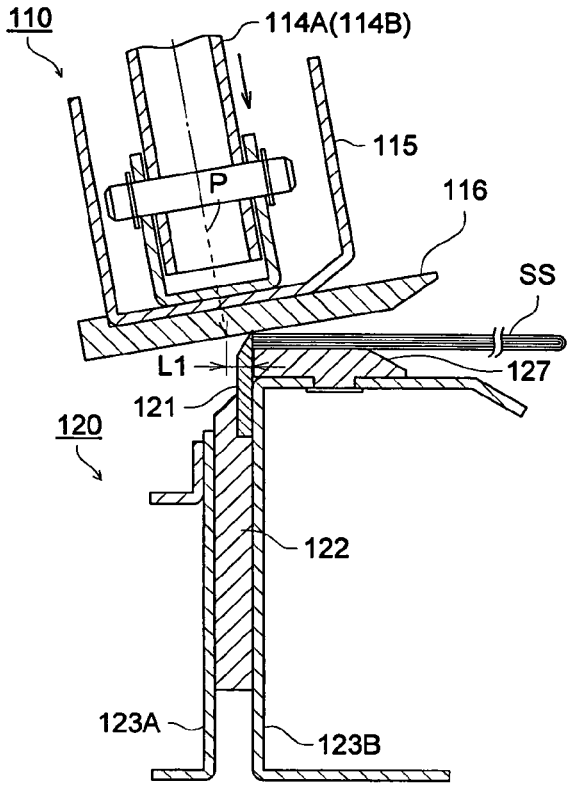
FIGS. 7(*a*) and 7(*b*) are the partial cross-sectional views of the cutting blade receiving member moving section and the cutting blade moving section showing an example in which the central position of the load application action of the cutting blade receiving member due to the cutting blade receiving member moving section is set outside a specific distance range.
Figure 7:
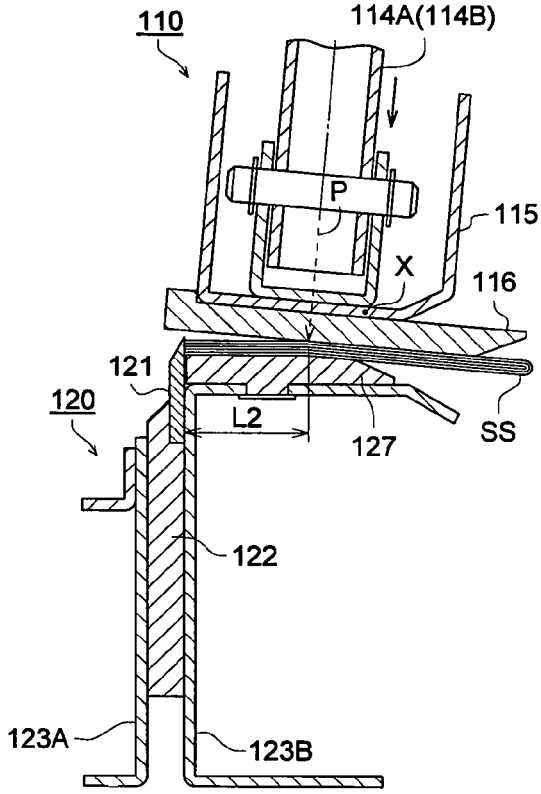

FIGS. 7(*a*) and 7(*b*) are the partial cross-sectional views of the cutting blade receiving member moving section 110 and the cutting blade moving section 120 showing an example in which the central position of the load application action of the cutting blade receiving member 116 is set outside a specific distance range.

FIG. 7(*a*) shows the example when the central position P of load application action is set to a distance L1 on the outside of the cutting blade 121. When this distance L1 is set to less than 0.5 mm, that is, when the central point P of load application action is either directly above the cutting edge of the cutting blade 121 or is towards the downstream side (towards the left in the figure) in the sheet transport direction in the neighborhood of the cutting edge of the cutting blade 121, the side of the cutting blade receiving member 116 that is not in pressure contact with the sheet bundle SS goes down thereby pressing the sheet bundle in an inclined state (the state of right part going down in the figure). If the cutting operation is made in this state, an abnormal load is applied on the cutting blade 121 that rises while sliding on the inner surfaces of the supporting plates 123A and 123B, thereby increasing the driving load of the cutting blade moving section 120. In addition, an abnormal force acts on the pointed cutting edge of the cutting blade 121 thereby causing the problems of damage to the cutting edge or reduction in its life, etc.

FIG. 7(*b*) shows the example when the central position P of load application action is set to a distance L2 that is at a distant position of 5 mm or more upstream side of the sheet transport direction of the cutting edge of the cutting blade 121. This distance L2 is set to more than or equal to 5 mm, that is, the central point P of load application action is set to a distance of L2, specifically, on the outside of the sheet supporting surface of the fixed supporting table 127 towards the upstream side in the sheet transport direction. In this case, due to the rising of the cutting edge of the cutting blade 121 a rotating moment acts in the neighborhood of one end of the cutting blade receiving member 116 and gets pushed up centering on the point X where the load is acting, thereby going into the inclined state (the state of right part going down in the figure). Because of this, the cutting blade receiving member 116 does not press fully in the neighborhood of the cutting position of the bundle of sheets SS, and hence it is likely that cutting defects are generated. In addition, an abnormal force acts on the pointed cutting edge of the cutting blade 121 coming into contact with the inclined cutting blade receiving member 116 thereby causing the problems of damage to the cutting edge or reduction in its life, etc.

It is possible to determine the pressing force of the cutting blade 121 depending on the specifications of the sheet bundle to be cut (type and thickness of sheets, etc.). Further, in order to cut while keeping the sheet bundle fixed, it is necessary that if the pressing force of the cutting blade receiving member 116 is at least larger than the pressing force of the cutting blade. While stability can be obtained by making large the pressing force of the cutting blade receiving member 116, it is inefficient in terms of equipment design and cost to make it too large. Therefore, it is desirable that the two pressing forces are almost equal and that their difference is not too large. In view of this, it is desirable to set the ratio (pressing force of the cutting blade receiving member 116)/(pressing force of the cutting blade 121) in the range of 1 to 1.3. At this time, by making the central position of load application action in the neighborhood along the sheet transport direction, it is possible to carry out good and accurate cutting without the cutting blade receiving member 116 from becoming inclined during cutting.

As a concrete example, when cutting sheet bundle of about 10 mm thickness, it is possible to carry out satisfactory cutting without the cutting blade receiving member from becoming inclined during cutting by setting the total pressing force of the cutting blade to 600 kg, the total pressing force of the blade receiving member to 800 kg, and the central position of load application action to 3 mm on the upstream side.

In the sheet cutting apparatus 100 according to the present invention, by setting the central position P of load application action of the cutting blade receiving member 116 due to the cutting blade receiving member moving section 110 to a point in the neighborhood on the upstream side along the sheet bundle transport direction relative to the cutting position, it is possible to carry out normal cutting of the edge 'a' of the sheet bundle SS without having an abnormal load acting on the cutting blade 121 and also while making smooth the drive of the cutting blade moving section 210. In addition, since there is no abnormal force acting on the pointed cutting edge of the cutting blade 121, the problems of damage to the cutting edge or reduction in its life, etc. will be solved.

FIGS. 8(*a*), 8(*b*), 8(*c*), and 8(*d*) are the perspective views and the cross-sectional views of different types of sheet bundles that are cut.

FIG. 8(*a*) is a perspective view of a center-folded and center-stapled bundle of sheets SS, FIG. 8(*b*) is a cross-sectional diagram of the bundle of sheets SS, where 'a' indicates the edge, 'b' the folding line section, 'c' the cutting line, and SP indicates the staple.

FIG. 8(*c*) is a perspective view of a side-stapled bundle of sheets SS, where 'a' indicates the edge, 'c' the cutting line, and SP indicates the staple.

FIG. 8(*d*) is a perspective view of a bundle of sheets SS after adhesive coating, where 'a' indicates the edge, 'c' the cutting line, and 'd' is the adhesive tape.

(Sheet Finishing Apparatus and Image Forming System Provided with a Sheet Cutting Apparatus)

Here, a sheet finishing apparatus and an image forming system provided with a sheet cutting apparatus refers to an a sheet finishing apparatus with a built-in sheet cutting apparatus, or an image forming system configured by connecting externally a sheet finishing apparatus with a built-in sheet cutting apparatus as shown in the figure. Further, it is possible to have a configuration in which the sheet finishing apparatus with a built-in sheet cutting apparatus according to the present invention can be used independently. Also, the sheet finishing apparatus and image forming systems having a sheet finishing apparatus according to the present invention need not be limited to the following preferred embodiments.

(Image Forming Apparatus)

Figure 9:
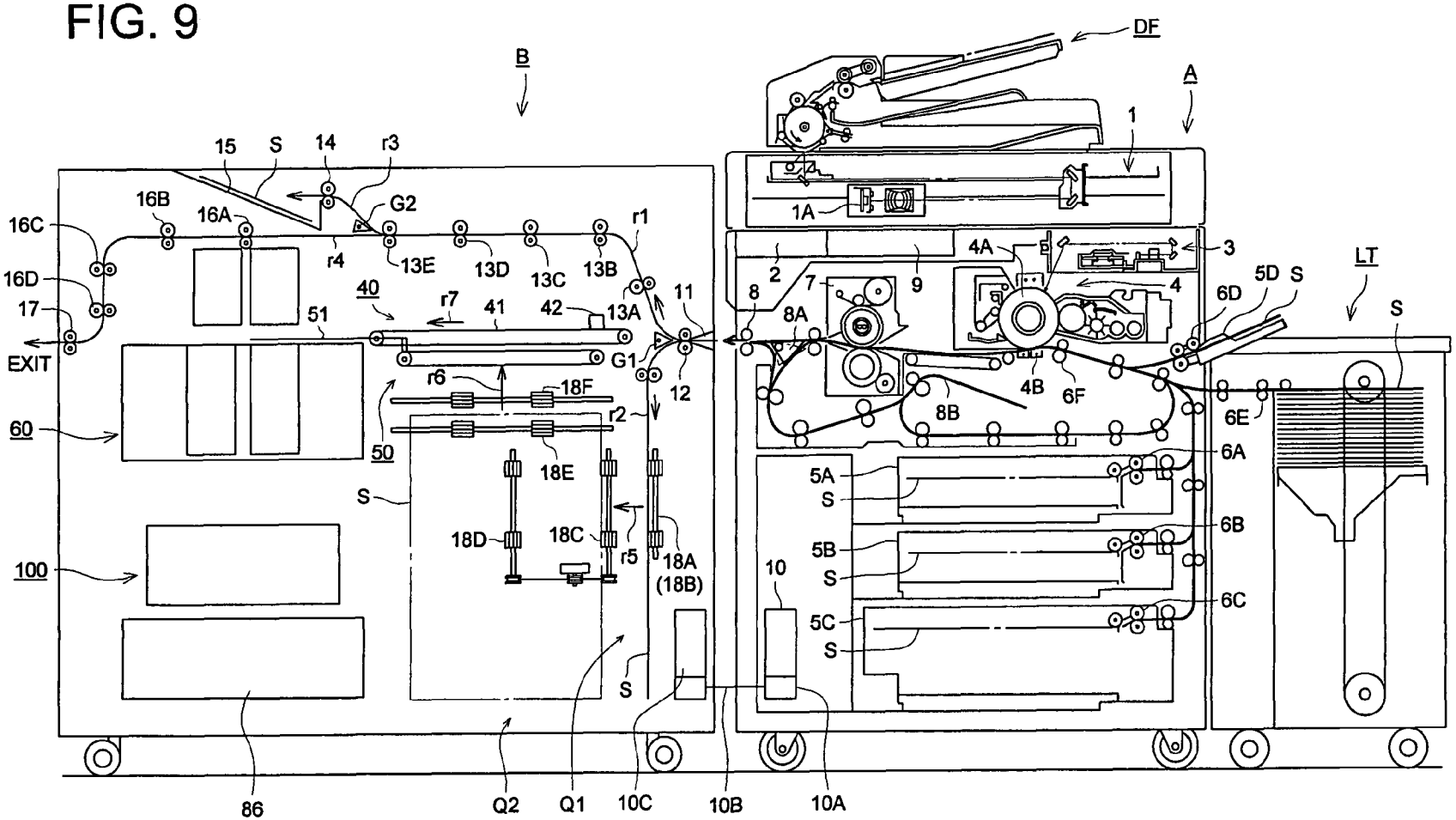
FIG. 9 is an overall configuration diagram of a sheet finishing apparatus employing a sheet cutting apparatus according to the present invention and of a corresponding image forming system.

FIG. 9 is an overall configuration diagram of a sheet finishing apparatus employing a sheet cutting apparatus according to the present invention and of a corresponding image forming system.

The image forming system is constituted by an image forming apparatus A, an automatic document feeding apparatus DF, a sheet finishing apparatus B, and a large capacity sheet feeding apparatus LT.

The image forming apparatus A shown in the figure is provided with the image reading section 1, the image processing section 2, the image writing section 3, the image forming section 4, the sheet loading cassettes 5A, 5B, 5C, and the manual sheet loading tray 5D, the first sheet loading sections 6A, 6B, 6C, and 6D, the second sheet loading section 6F, the fixing apparatus 7, the sheet discharging section 8, and an automatic double-side copy sheet feeding section (ADU) 8B.

The sheet finishing apparatus B having the sheet cutting apparatus 100 described above is coupled on the side of the sheet discharge section 8 on the left side face shown in the figure of the image forming apparatus A.

The image on one side or on both sides of the original document placed on the document table of the automatic document feeding apparatus DF is read by the optical system of the image reading section 1, read in as electrical data by the CCD image sensor 1A, and the analog signal obtained by photoelectric conversion is subjected in the image processing section 2 to various processing such as analog signal processing A/D conversion, shading correction, image compression, etc., and sent to the image writing section 3.

In the image writing section 3, the output light from a semiconductor laser is irradiated on the photosensitive drum 4A of the image forming section 4, thereby forming the latent image. The different processes of electrostatic charging, exposure, development, transfer, separation, cleaning, etc., are carried out in the image forming section 4. The sheet S fed and transported from each of the first sheet feeding sections 6A to 6C of the sheet feeding cassettes 5A to 5C, the first sheet feeding section 6D of the manual sheet feeding tray 5D, and the first sheet feeding section 6E of the large capacity sheet feeding apparatus LT is passed through the second sheet feeding section 6F and the image is transferred on to it by the transfer section 4B. The sheet carrying the image is fixed by the fixing apparatus 7, and is sent to the sheet finishing apparatus B from the sheet discharging section 8. On the other hand, a sheet S with image forming completed on one of its sides and sent by the transport path selection plate 8A to the automatic double-side copy sheet feeding section 8B is again subjected to the processing in the image forming section 4, and is discharged from the sheet discharging section 8 after images are formed on both sides of the sheet.

The operation section 9 is used for selecting and setting the processing functions of the image forming system constituted by the image forming apparatus A and the sheet finishing apparatus B, etc.

The main control section 10 of the image forming apparatus A is connected to the sheet finisher control section 10C of the sheet finishing apparatus B via the communication section 10A and the communication lines 10B.

(Sheet Finishing Apparatus)

Figure 10:
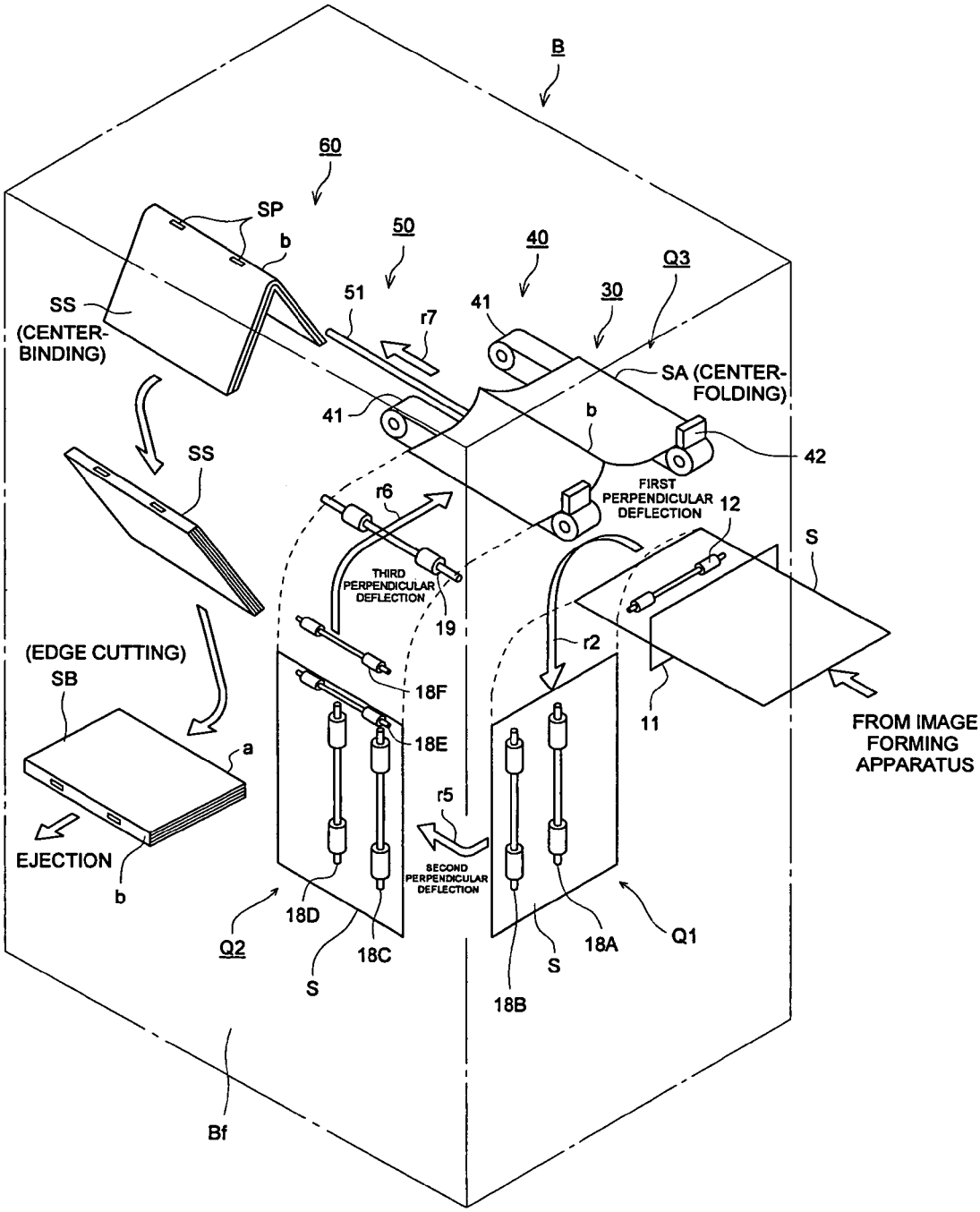
FIG. 10 is a schematic diagram showing the sheet transport during the center-folding and center-stapling processes of the sheet finishing apparatus.
Figure 11:
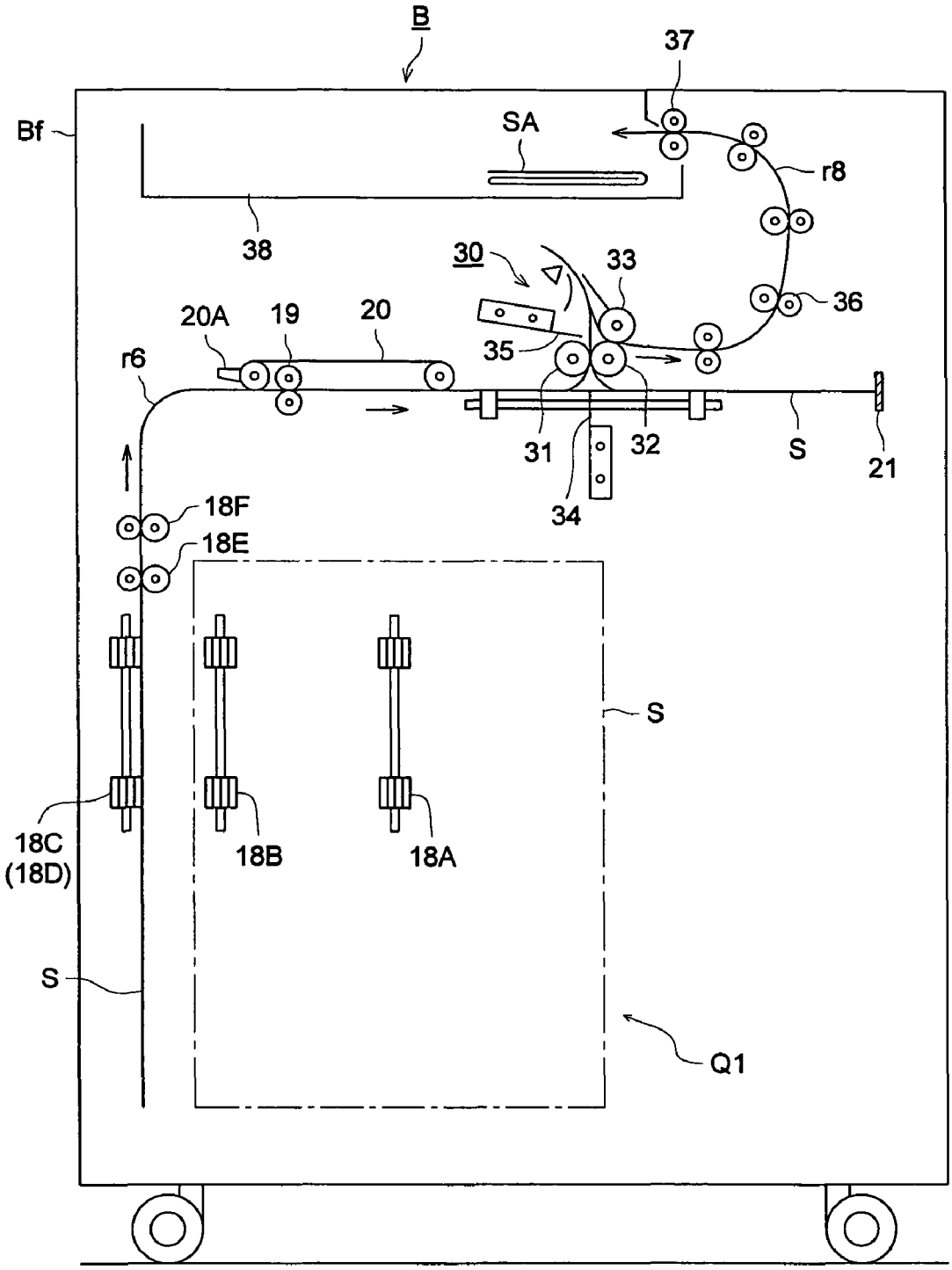
FIG. 11 is a right side view of the sheet finishing apparatus.
Figure 12:
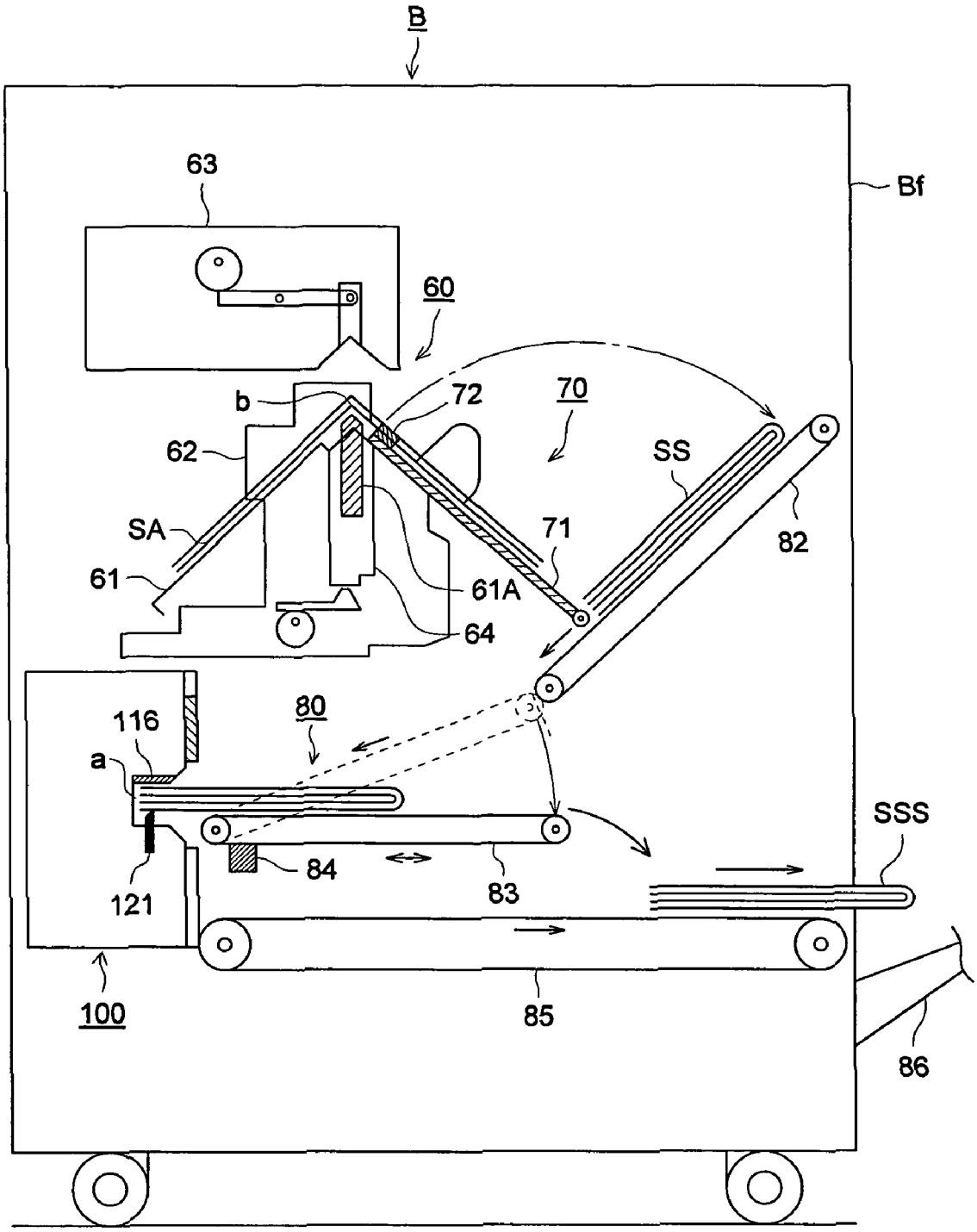
FIG. 12 is a left side view of the sheet finishing apparatus.

FIG. 10 is a schematic diagram showing the sheet transport during the center-folding and center-stapling processes of the sheet finishing apparatus B. FIG. 11 is a right side view of the sheet finishing apparatus B and FIG. 12 is a left side view of the sheet finishing apparatus B.

To start with, the sheet transport process from introduction to just before folding is described here.

As is shown in FIGS. 9 and 10, when the sheet S discharged from the image forming apparatus A is introduced into the inlet section 11 of the sheet finishing apparatus B, it is pinched by the inlet roller 12, and is transported to the upper sheet transportation path r1 or the lower sheet transportation path r2 of the sheet transportation path selection section G1.

<Straight Discharge>

The sheet S branched to the sheet transportation path r1 is gripped and transported by the transport rollers 13A to 13E, and is transported to either the upper sheet transportation path r3 or the lower sheet transportation path r4 of the sheet transportation path selection section G2.

The sheet S that has proceeded to the upper sheet transportation path r3 is discharged by the discharge roller 14, and is stacked on the auxiliary sheet discharge tray 15 provided in the top part of the sheet finishing apparatus B.

The sheet S that has proceeded to the lower sheet transportation path r4 is gripped and transported by the transport rollers 16A to 16D, and is discharged by the discharge roller 17.

<First Right Angle Direction Change Transport>

The sheet S that has proceeded to the lower sheet transportation path r2 of the transportation path selection section G1 is lowered almost vertically and is stored after making a temporary stop at a specific position. At this first stopping position Q1 several succeeding sheets of paper S are stacked one upon the other and stored.

<Second Right Angle Direction Change Transport>

The stored sheet S is moved after changing the orientation to a direction at right angles to the sheet surface towards the front as shown in FIG. 11 by the transport roller pairs 18A and 18B, the first transport roller pairs 18C and 18D, and a guide plate not shown in the figure, and passes through the sheet transport path r5 that goes around the inner front side Bf of the sheet finishing apparatus B in a state in which the sheet surface is vertical, and makes a temporary stop at the second stopping position Q2.

<Third Right Angle Direction Change Transport>

Next, after the sheet S is transported vertically by the second transport roller pair 18E, its direction is changed to the horizontal direction, and is transported by the transport roller pair 19 and the transportation aligning belt 20 (refer to sheet transportation path r6 in FIG. 10).

<Alignment Before Folding Operation>

As is shown in FIG. 11, the alignment section is placed on the downstream side in the sheet transportation direction with respect to the sheet transportation path r6, and has an aligning member 21 that is used for positioning by pushing the leading edge part of the sheets against it, and the movable aligning member 20A that moves the sheet S by pushing against its trailing edge part. The aligning member 20A pushes the trailing edge part of the sheet S transported by the transport roller pair 19 placed on the upstream side in the sheet transport direction with respect to the sheet transportation path r6 and moves the sheet up to the aligning member 21, carries out aligning of the sheets by making the leading edge part of the sheets to come into contact with the aligning member 21, and finally comes to a temporary stop at the third stopping position Q3.

Next, the processes of center-folding, center-stapling, and booklet edge cutting of the sheet S in the sheet finishing apparatus B are described here concretely.

The folding section 30 is provided on the downstream side of the transportation aligning belt 20 along the sheet transportation direction. The folding section 30 is constituted by the folding rollers 31, 32, and 33, the first folding plate 34, and the second folding plate 35, etc. When carrying out the operation of folding into three, in the folding section 30, the first folding line part is formed in the sheet S by the folding rollers 31 and 32 and the first folding plate 34, the second folding line part is formed in the sheet S by the folding rollers 32 and 33 and the second folding plate 35, and the folded sheet SA folded into three passes through a sheet transportation path r8 comprising a plurality of transport rollers 36 and guide plates, and is discharged to the sheet discharge tray 38 by the sheet discharge roller 37 (see FIG. 11).

<Center-Folding Process>

The one or several sheets of paper S arriving at the folding section 30 are gripped by the rollers 31 and 32 that rotate in mutually opposite direction and by the first folding plate 34 that moves forward thereby carrying out the center-folding operation of the sheet S, and the folded sheet SA is formed in which has been formed the folding line part 'b' along the breadth direction of the sheet at the center of the sheet transportation direction.

The folded sheet SA which has been folded into two and the folding line part 'b' formed in it by the folding rollers 31 and 32, and the first folding plate 34 is separated from the nipping position of the folding rollers 31 and 32 and returned to the original horizontal transportation path due to the reverse rotations of the folding rollers 31 and 32. In FIG. 10, the folded sheet SA is transported further to the sheet transportation path r7 in the direction of an extension line of the folding line part 'b' by the transport belt 41 of the transportation section 40 to be described later, the transportation tab 42, and the introduction guiding member 51 of the folding sheet guiding section 50, and is then transported to the center-folding section 60 (see FIG. 10).

In this manner, because the folding section 30 carries out center-folding of a small number of sheets such as 1 to 3 sheets, firmly forms the folding line part 'b' and successively sends them to the folding section 60, it is possible to produce a high quality bundle of sheets SS with very small bulging of the folding line part 'b'.

<Center-Folding Process>

The folded sheet SA center-folded in the folding section 30 is transported in the direction of the sheet transportation path r7 by the transportation section 40 to be described later, and is placed on top of the saddle-shaped stacking section 61 of the center-folding section 60. The succeeding center-folded sheets SA also pass through the sheet transportation path r7 and are stacked on top of the saddle-shaped stacking section 61.

In FIG. 12, the saddle-shaped stacking section 61 is formed from two guide plates that are almost at right angles to each other, and is fixed to the body of the sheet finishing apparatus B. Near the apex part of the saddle-shaped stacking section 61 is placed a pressing member 61A that can move up or down due to the action of a spring and in the state in which it is supported by the staple receiving mechanism 64.

The apex part of the pressing member 61A has a projection shape at the top that is almost right angle, and the folding line part 'b' (see FIG. 12) of the center-folded sheet SA is placed on the ridge line of the apex part.

The plurality of folded sheets SA placed on top of the saddle-shaped stacking section 61 and the pressing member 61A are adjusted for position by the width aligning section 62.

The stapling mechanism 63 is placed in a fixed position above the pressing member 61A. Inside the saddle-shaped stacking section 61, the pressing member 61A and the staple receiving mechanism 64 are supported in a movable manner along the up-down direction.

Two sets of the stapling section having a divided structure and comprising the stapling mechanism 63 and the staple receiving mechanism 64 are provided along the sheet folding line direction. If the center-folding process has been set in the operating section, the staple receiving mechanism 64 rises thereby carrying out the center-folding operation. In other words, the two sets of stapling section staple the staple pins SP at two locations equidistant from the center along the folding line part 'b' of the folded sheet SA above the pressing member 61A. The center-folded and center-stapled bundle of sheets SS is shown by the schematic diagrams in FIGS. 8(*a*) and 8(*b*).

<Taking Out Booklets>

The bundle of sheets SS center-stapled in the center-stapling section 60 is supported by the supporting member 72 fixed to the tip part of the arm member 71 of the booklet take-out section 70, and is transported to the booklet transporting section 80 after being swung in the direction of the dot and dash arrow by the arm member 71.

<Booklet Transportation>

The bundle of sheets SS transported to the booklet transporting section 80 is placed above the transportation belt 82. The bundle of sheets SS is transported in the diagonally downward direction due to the rotation of the transportation belt 82 is subsequently retained in the inclined state, transported by the rotating transportation belt 83, and stops at a specific position. Thereafter, the transportation belt 83 swings and is supported in the horizontal state.

<Booklet Cutting Operation>

Since the edge 'a' of the bundle of sheets SS (the free end part on the side opposite to the folding line part) placed above the transportation belt 83 after it has gone into the horizontal state would not be aligned depending on the number of sheets in the bundle of sheets SS, the edge 'a' is cut and aligned by cutting using the sheet cutting apparatus 100 according to the present invention.

The booklet SSS prepared by cutting the edge is placed above the transportation belt 83 that is rotating in the reverse direction, and is transported in the state in which the rear end part of the booklet SSS is pushed by the movable aligning member 84 fixed to the transportation belt 83, and the booklet falls from the front end part of the transportation belt 83 in the direction of the arrow. The booklet SSS that has fallen is discharged by the rotating discharge belt 85 to the sheet discharge tray 86 placed outside the front panel side Bf of the sheet finishing apparatus B.

Further, the sheet cutting apparatus 100 according to the present invention need not be limited to the processing of edge cutting of the bundles of sheets SS that has been center-folded and center-stapled by the sheet finishing apparatus B, and can also be applied to the edge cutting operation of side-stapled bundles of sheets SS shown in FIG. 8(*c*), or the edge cutting operation of bundles of sheets SS after adhesive application as shown in FIG. 8(*d*).

According to the present preferred embodiment, a sheet cutting apparatus is realized that is small in size, can offer good finish of the booklets irrespective of whether the number of sheets is large or small, and also has reduced cutting blade driving load making it possible to drive using a small power.

According to the present preferred embodiment, a sheet cutting apparatus is realized that produces booklets by cutting the edges of sheets of bundle that have been subjected to the finishing operation of center-folding and center-stapling.

According to the present preferred embodiment, an image forming system is realized that provides in an on-demand manner booklets that are prepared by subjecting to finishing operations of the sheets on which images have been formed.

What is claimed is:

1. A sheet cutting apparatus comprising:

(a) a cutting blade having a cutting edge structured to cut an edge of a sheet bundle conveyed to a cutting position of the sheet bundle;

(b) a cutting blade moving section structured to move obliquely the cutting blade with respect to a sheet surface of the sheet bundle;

(c) a fixed supporting table structured to support the sheet bundle in a vicinity of the cutting position;

(d) a blade receiving member having a flat surface structured to press an upstream side of the sheet bundle with respect to the cutting position in a conveying direction of the sheet bundle to the cutting position between the fixed supporting table and the blade receiving member, the blade receiving member receives and contacts the cutting edge of the cutting blade in the vicinity of the cutting position, the flat surface of the blade receiving member which comes in contact with the sheet bundle being integrally formed and made of a same material, and the blade receiving member structured to be slidable in the conveying direction of the sheet bundle so that a receiving position of the blade receiving member to receive the cutting blade can be changed and a center position of a load application action of the blade receiving member is kept constant when the blade receiving member is slid, wherein the cutting blade cuts a downstream side of the sheet bundle with respect to the cutting position; and (e) a blade receiving member moving section provided with the blade receiving member structured to lower the blade receiving member so as to press the sheet bundle between the fixed supporting table and the blade receiving member when the cutting blade moves upward and cuts the edge of the sheet bundle, and raises the blade receiving member so as to be separated from the fixed supporting table when the cutting blade moves downward, wherein the center position of the load application action of the blade receiving member by the blade receiving member moving section, is set to the upstream side of the cutting position in the conveying direction of the sheet bundle, and in the vicinity of the sheet cutting position.

2. The sheet cutting apparatus of claim 1, wherein the cutting blade has a lengthy shape.

3. The sheet cutting apparatus of claim 1, wherein the cutting blade moving section moves the cutting blade upwardly when the sheet bundle is cut.

4. The sheet cutting apparatus of claim 1, wherein the blade receiving member moves downwardly when the sheet bundle is cut.

5. The sheet cutting apparatus of claim 2, further comprising a second blade receiving member moving section for moving the blade receiving member in a direction perpendicular to a longitudinal direction of the cutting blade.

6. The sheet cutting apparatus of claim 1, wherein a ratio of pressing force for the cutting blade receiving member to a pressing force of the cutting blade is in a range of 1 to 1.3.

7. The sheet cutting apparatus of claim 6, wherein the following expression is satisfied, (the pressing force of the blade receiving member)/(the pressing force of the cutting blade) 1 to 1.3.

8. The sheet cutting apparatus of claim 1, wherein the center position of the load application action of the blade receiving member is provided upstream of the cutting position by 0.5 to 5.0 mm in the conveying direction of the sheet bundle.

9. A sheet finisher comprising the sheet cutting apparatus described in claim 1.

10. An image forming system comprising the sheet finisher described in claim 9.

11. The sheet cutting apparatus of claim 5, the second blade receiving member moving section comprises solenoid.

* * * * *